United States Patent [19]

Gerhards

[11] Patent Number: 4,555,034

[45] Date of Patent: Nov. 26, 1985

[54] BEER MUG

[75] Inventor: Ludwig Gerhards, Ransbach-Baumbach, Fed. Rep. of Germany

[73] Assignee: Clemens Gerhards Holzwarenfabrik KG, Ransbach-Baumbach, Fed. Rep. of Germany

[21] Appl. No.: 553,472

[22] Filed: Nov. 18, 1983

[30] Foreign Application Priority Data

Nov. 18, 1982 [DE] Fed. Rep. of Germany ..... 3242567

[51] Int. Cl.[4] ..... B65D 23/12

[52] U.S. Cl. ..... 215/100 R; 215/235; 215/236; 220/94 R

[58] Field of Search ..... 215/13 R, 100 R, 100 A, 215/235, 236, 239, 240, 241; 220/94 R, 334, 335, 336

[56] References Cited

U.S. PATENT DOCUMENTS

| | | | |
|---|---|---|---|
| 29,666 | 8/1860 | Bryce | 215/235 |
| 232,730 | 9/1880 | Knowles | 215/235 |
| 1,094,469 | 4/1914 | Pick | 215/235 |
| 1,291,284 | 1/1919 | Valent | 215/100 R |
| 2,056,879 | 10/1936 | Winterhalter et al. | 215/235 |
| 2,753,051 | 7/1956 | Tupper | 215/235 |
| 2,944,691 | 7/1960 | Serio | 215/100 R |
| 3,334,782 | 8/1967 | Friberg | 220/94 R |

FOREIGN PATENT DOCUMENTS

| | | | |
|---|---|---|---|
| 131181 | of 0000 | Fed. Rep. of Germany | 215/235 |
| 214545 | 4/1924 | Fed. Rep. of Germany | 215/13 R |

*Primary Examiner*—Joseph Man-Fu Moy
*Assistant Examiner*—David T. Fidei
*Attorney, Agent, or Firm*—Michael J. Striker

[57] ABSTRACT

A beer mug is formed of the mug container and a lid made out of wood. The lid is hingedly connected to the handle secured to the mug container and can be releasably attached to the handle by a snapping connecting device which includes a connecting element of an elastic plastics on the lid and a hinge mounted on the handle and provided with a pivot which can be snapped into a slot formed on the end portion of the elastic connecting element.

2 Claims, 7 Drawing Figures

BEER MUG

BACKGROUND OF THE INVENTION

The present invention relates to beer mugs provided with lids hingedly attached to the mugs.

It was preferable some years ago to serve beer in beer mugs provided with hingeable lids to longer preserve froth and flavor of the beer being served under the lid. Fine feavors of the hop escape the beverage particularly fast together with carbon acids when the beer in the mug is not covered.

Therefore, even nowdays, it has been a desire of the majority of beer lovers to drink beer from the mugs covered with lids. There have been, however, two problems with the mugs covered with lids; first, it has been troublesome to fill such mugs with beer, and secondly, such used mugs have required a fussy cleaning. Furthermore, the material of the lids has been also important. Metallic lids are stable but they affect the flavor of beer. Ceramic lids are neutral to flavor but one has to be very careful while washing and rinsing ceramic lids to avoid splintering or cracks. The lid which is not neutral to flavors affects the flavor of the beer at the very beginning and the lid should be placed onto the froth. Heavy lids in time can damage the rim of the beer mug so that the rim will eventually have a number of cracks.

Lids made of wood, which are neutral to flavors and stable and which were used some years ago, have been eliminated from modern gastronomy because, due to the shortage of personnel, on the one hand, and to high hygienic requirements, on the other hand, it has been found difficult to wash wood with modern suitable fast rinsing methods. However, despite of the aforementioned problems, the majority of customers even at the present time prefer to drink beer from the mugs having hingeable wood lids.

SUMMARY OF THE INVENTION

It is an object of the present invention to provide an improved beer mug.

It is a further object of the present invention to provide a coverable beer mug which can be fast and without problems filled with beer and which meets hygienic requirements of the present time.

It is still another object of the present invention to provide a beer mug which can be easily washed up without damaging the wood material of the lid.

These and other objects of the invention are attained by a beer mug, comprising a mug body having a handle; a lid hingedly connectable to said body, said lid being made of wood; and connecting hinge means formed of water and rinsing-medium-resitant material and pivotally supported on said handle, said connecting means including elastic snapping means on said lid which can be attachingly-releasably connected to the body of the mug.

According to a further concept of the invention the elastic snapping means may include a connecting element formed of an elastic synthetic plastic material and rigidly connected to said lid, said connecting element having an end portion formed with a transverse bore and a slot connected to said bore, and a hinge slider arranged on said handle and having a pivoting axle adapted to be releasably snapped into said bore through said slot.

The lid may be formed with a projecting arm, said connecting element being rigidly connected to said projecting arm.

The beer mug may further include an operating knob rigidly connected to said connecting element and operated to attach or release said elastic connecting element from said pivoting axle.

The hinge slider may include gripping portions gripping the handle of the mug.

The hinge slider may further include a supporting finger for supporting the slider on the handle.

According to still a further concept of the invention the elastic snapping means may include a pivoting arm formed of water and rinsing-medium-resistant elastic material and rigidly connected to said handle, said pivoting are including a fork-like portion formed with a slot and with opposite holding projections in said slot, said lid having a connecting extension formed with a hole, said fork-like portion being adapted to be releasably snapped into said extension so that said projections are snapped into said hole. In this embodiment the mug can also comprise an operating knob rigidly connected to said pivoting arm and operated to attach or release said pivoting are from said extension.

Thus, the beer mug according to the invention has the advantages of the mugs utilized some years back and which were removed from the customer's industry because modern agressive rinsing means could damage the wood, particularly cause a warping or discoloration or producing unnecessary flavors in wood. The advantages of the mug include conservation of flavor, esthetic properties and small weight. At the same time the mug according to this invention meets high modern hygienic requirements.

The mug with detachable lid of wood can again enter the market and customer's industry.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
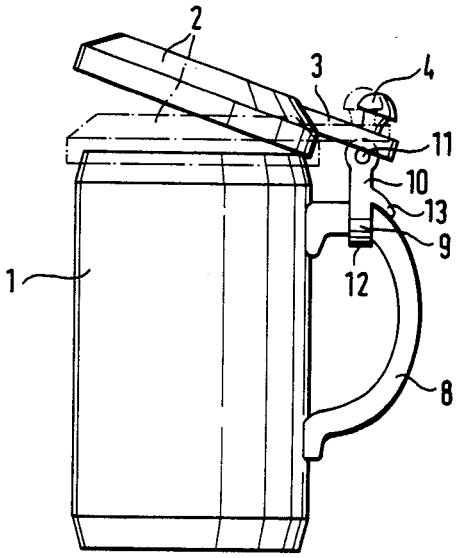
FIG. 1 is a side view of the beer mug of the invention with a lid in an open position.

Referring now to the drawings, and firstly to FIG. 1, it will be seen that a beer mug according to the invention includes a mug body 1 made of ceramic and a lid 2 formed of wood. When attached to a handle 8 of the mug body 1 by connecting means, which will be explained below the lid is hingedly supported on the handle 8 and can be easily placed by a user to an open or closed position. The wood lid 2 in the first embodiment of the invention illustrated in FIGS. 1 through 4 has an elongated pivoting arm 3 protruding in the direction of the handle 8. An operating knob 4 is positioned at the free end of pivoting arm 3. The arm 3 and operating knob 4 are preferably fabricated of wood.

Figure 4:
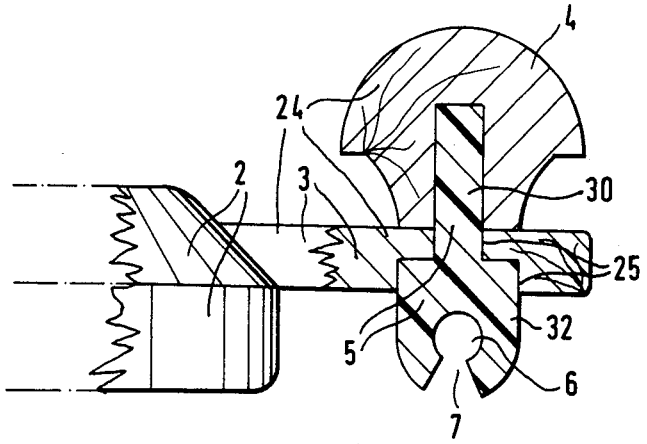
FIG. 4 is an enlarged sectional view of the portion of the connecting means of FIG. 3 on the lid of the beer mug.

A steplike bore 25, as shown in FIG. 4, is provided in the arm 3, which receives a connecting piece or element 5 made of elastic synthetic plastic material which is water-resistant. The connecting element 5 has an elongated narrowed pin-like portion 30 which extends into a recess formed in wood knob 4. This connecting element is rigidly connected, for example glued, to the arm 3 and knob 4 so as to form a connecting unit 24 on the lid 2. A widened portion 32 of connecting element 5 extended downwardly from arm 3, is formed with a transverse hole 6 which merges into a V-shaped slot 7.

Figure 2:
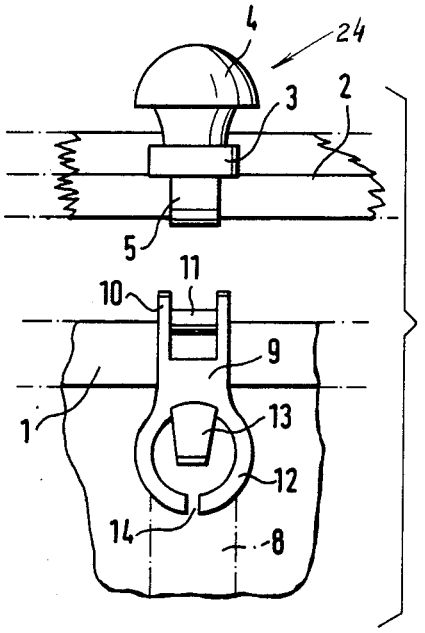
FIG. 2 shows a rear view of connecting means of the invention in a detached position.
Figure 3:
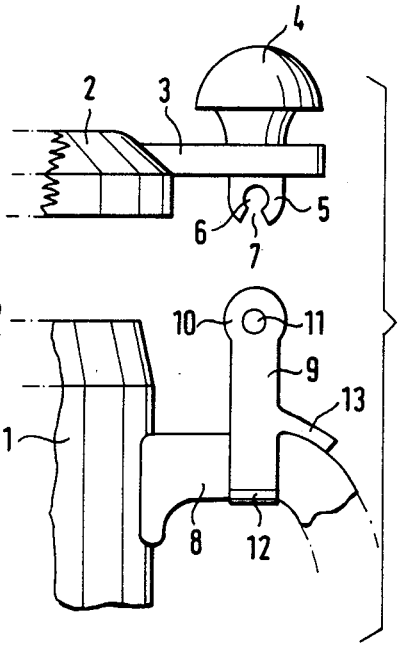
FIG. 3 shows a side view of the connecting means of FIG. 2.

With reference to FIGS. 1–3 it will be seen that a hinge slider 9 is mounted on the handle 8 so as to surround the handle with gripping portions 12 provided on slider 9. The latter is also formed with a fork-like uper portion 10 which receives a pivoting axle 11 between the projections forming the fork. When the lid 2 is attached to the mug the pivoting axle 11 is snapped into hole 6 through slot 7 and is held therein. Since the connecting element 5 is formed of elastic material, the lower portion 32 thereof forms with axle 11 a snapping connection; the lid 2 with pivoting arm 3 is thus pivotally connected to handle 8 by said snapping connection.

The gripping portions 12 surround handle 8 and slider 9 is supported on handle 8 by means of a supporting finger 13. Slider 9 is made of synthetic plastic material and can be fabricated as well as connecting element 5 by injection molding. The gripping portions 12 can be connected to each other at the inner side of the handle 8 by a weld which would extend through ends 14 of gripping portions 12. If practical the hingle slider 9 can be formed of a suitable metal.

In use of the beer mug the lid 2 can be released from the mug body. For this purpose the operating knob 4 is pulled upwardly and the snapping connection is released resulting in the separation of connecting element 5 from the slider 9 (FIGS. 2 and 3). The beer mug and wood lid can be any time separated from each other, washed up and stored separately. Beer can be poured in the mug without the lid attached to the mug and the lid can be connected to the mug again when necessary.

Figure 5:
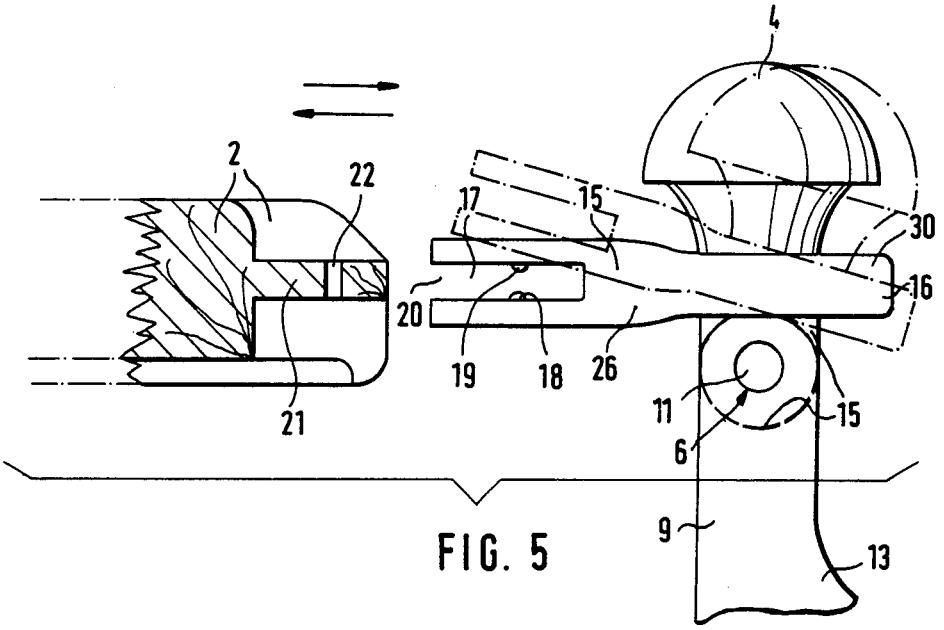
FIG. 5 illustrates a side view, partially in section of the connecting means in a detached position, according to a modified embodiment of the invention.
Figure 6:
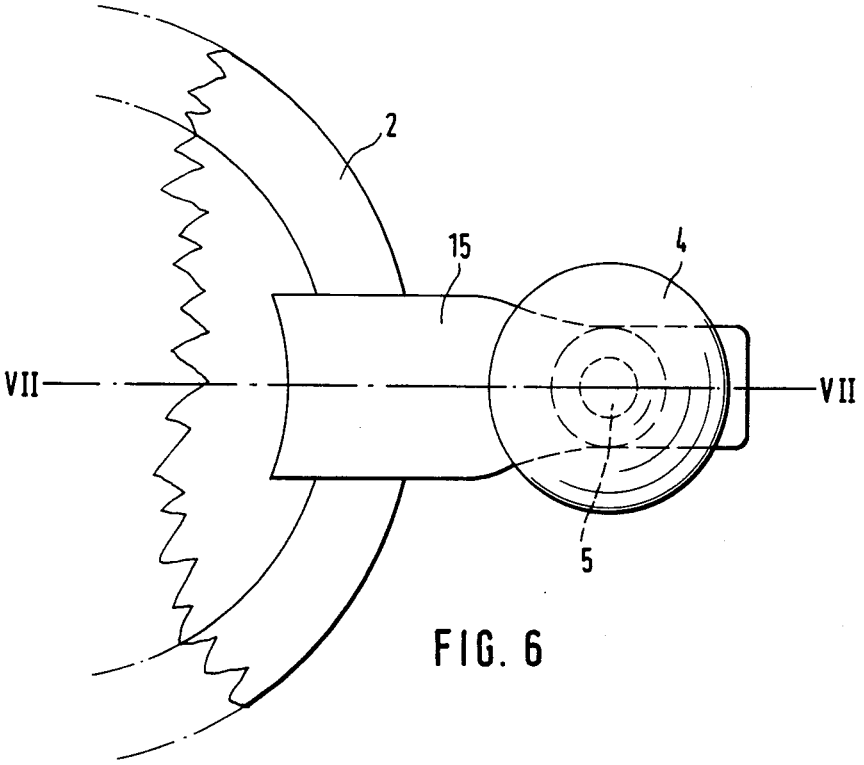
FIG. 6 is a top plan view of the connecting means of FIG. 5 in an attached position.
Figure 7:
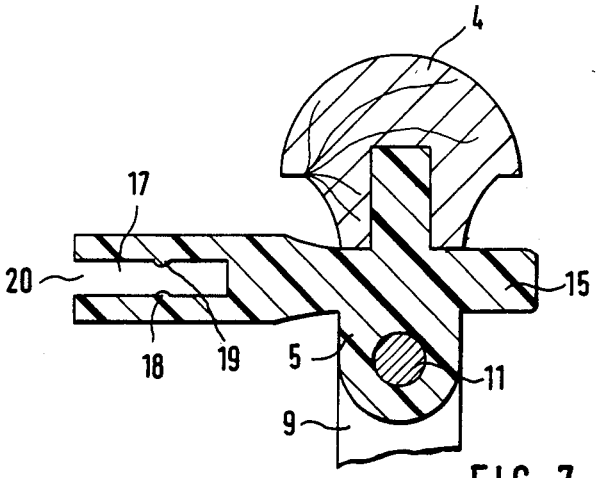
FIG. 7 is a sectional view on line VII—VII of FIG. 6.

Reference is now made to FIGS. 5 through 7 which illustrate another embodiment of the snapping connections means. In the modified embodiment of the invention the pivoting arm is separated from the lid. The pivoting arm, which is denoted as 15, is formed of an elastic synthetic plastic material and has an elongated fork-like projection 17. The operating knob 4 in this embodiment has the same construction as that of FIGS. 1 through 4.

The pivoting arm 15, as shown in FIG. 7, is further provided with an elongated pin-like narrowed portion 16 inserted into a recess of knob 4 and rigidly glued therein, and a widened portion 26 formed with an opening 20, portion 16 and portion 20 extending opposite to each other and substantially normal to fork-like portion 17. The inner opposite faces of the fork-like portion 17 are provided with holding projections 18, 19. The connecting element 5, here part of the pivoting are 15, joins this via bore 6 and pivoting axle 11 to the handle of the mug. The wood lid 2 as shown in FIG. 5 is formed with a holding tongue or projection 21 provided with a bore 22. When projection 21 of cover 2 is inserted into the slot of the fork-like portion 17 projections 18, 19 are snapped into bore 22 to form a snapping connection.

Since the pivoting arm 15 in the embodiment of FIGS. 5—7 is fixedly linked to the beer mug and they are actuated together and can be also washed up together it is expedient to make the operating knob out of ceramic or synthetic plastic material.

It will be understood that each of the elements described above, or two or more together, may also find a useful application in other types of beer mugs differing from the types described above.

While the invention has been illustrated and described as embodied in a beer mug, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A beer mug, comprising a mug body having a handle, a lid hingedly connectable to said body, said lid being made of wood; connecting hinge means formed of water-and-rinsing-medium-resistant material and pivotally supported on said handle, said connecting means including snapping means, said snapping means including a first portion rigidly connected to said lid and a second portion connected to said handle, one of said first and second portions being of elastic plastics and being snappingly connectable to another of said portions to connect said lid to said body and being disconnectable from another of said portions to instantly release said lid from said body; and an operating knob rigidly connected to said one elastic portion and operated to attach or release said one elastic portion from said another portion, said second portion being a pivoting arm formed of water-and-rinsing-medium-resistant elastic material and including a fork-like portion formed with a slot and with opposite holding projections in said slot, said lid having a connecting extension forming said first portion and provided with a hole, said fork-like portion being adapted to be releasably snapped into said extension so that said projections are snapped into said hole.

2. The mug as defined in claim 1, wherein said operating knob is rigidly connected to said pivoting arm and operated to attach or release said pivoting arm from said extension.

* * * *